US010655846B2

(12) United States Patent
Cadima

(10) Patent No.: US 10,655,846 B2
(45) Date of Patent: May 19, 2020

(54) GAS BURNER ASSEMBLY FOR A COOKTOP APPLIANCE

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 164 days.

(21) Appl. No.: 15/706,838

(22) Filed: Sep. 18, 2017

(65) Prior Publication Data

US 2019/0086077 A1 Mar. 21, 2019

(51) Int. Cl.

| | |
|---|---|
| ***F23D 14/06*** | (2006.01) |
| ***F23D 14/24*** | (2006.01) |
| ***F23D 14/62*** | (2006.01) |
| ***F23N 1/00*** | (2006.01) |
| ***F24C 3/00*** | (2006.01) |

(52) U.S. Cl.

CPC ..... *F23D 14/06* (2013.01); *F23D 14/24* (2013.01); *F23D 14/62* (2013.01); *F23D 2900/14021* (2013.01); *F23D 2900/14062* (2013.01); *F23N 1/002* (2013.01)

(58) Field of Classification Search

CPC .. F24C 3/085; F24C 3/08; F24C 15/10; F23D 14/06; F23D 2900/14062; A47J 37/0713

USPC ..... 126/39 R, 39 E, 39 H, 39 N, 39 J, 39 K

See application file for complete search history.

(56) References Cited

U.S. PATENT DOCUMENTS

| | | | | |
|---|---|---|---|---|
| 2,805,710 A * | 9/1957 | Brumbaugh | ..... | F23D 14/06 239/544 |
| 5,209,217 A * | 5/1993 | Beach | ..... | F24C 3/126 126/21 R |
| 5,690,483 A * | 11/1997 | Oda | ..... | F23D 14/06 431/266 |
| 5,915,956 A | 6/1999 | Kwiatek et al. | | |
| 8,381,714 B2 | 2/2013 | Shaffer et al. | | |

(Continued)

FOREIGN PATENT DOCUMENTS

| | | | | |
|---|---|---|---|---|
| CA | 2307647 A1 * | 4/1999 | ..... | F23D 14/06 |
| CN | 2718400 Y * | 8/2005 | | |

(Continued)

OTHER PUBLICATIONS

Gollahalli, S R. "Jet flames from noncircular burners". Sadhana, vol. 22, Part 3. Jun. 1997.*

(Continued)

*Primary Examiner* — Vivek K Shirsat
*Assistant Examiner* — Christopher Matthew Odell
(74) *Attorney, Agent, or Firm* — Dority & Manning, P. A.

(57) ABSTRACT

A gas burner assembly for a cooktop appliance is provided including a lower body and an upper body positioned over the lower body to define a boost burner chamber. A first plurality of projections extends upward from the lower body and a second plurality of projections extends downward from the upper body. The second plurality of projections are interposed between the first plurality of projections to define a plurality of burner ports in fluid communication with the boost burner chamber. In this manner, burner ports are easily manufactured and define a larger height-to-width aspect ratio for improved burner performance.

20 Claims, 9 Drawing Sheets

(56) References Cited

U.S. PATENT DOCUMENTS

| | | | | |
|---|---|---|---|---|
| 8,845,326 | B2 | 9/2014 | Shaffer et al. | |
| 2011/0108016 | A1 * | 5/2011 | Shaffer | F23D 14/06 126/39 E |

FOREIGN PATENT DOCUMENTS

| | | | | |
|---|---|---|---|---|
| CN | 204438127 | U | 7/2015 | |
| CN | 103900103 | B | 1/2016 | |
| EP | 2072900 | A1 * | 6/2009 | F23D 14/02 |
| JP | 6062509 | B2 | 1/2017 | |
| WO | WO-2013183981 | A1 * | 12/2013 | F23D 14/58 |

OTHER PUBLICATIONS

Jones, H. R. N. "The Application of Combustion Principles to Domestic Gas Burner Design". Taylor & Francis, 1989.*
"Machine Translation of WO2013183981A1".*
"Machine Translation of CN2718400Y".*

* cited by examiner

GAS BURNER ASSEMBLY FOR A COOKTOP APPLIANCE

FIELD OF THE INVENTION

The present subject matter relates generally to cooktop appliances and more particularly to gas burner assemblies for cooktop appliances.

BACKGROUND OF THE INVENTION

Gas burners are commonly used on the cooktops of household gas cooking appliances including e.g., range ovens and cooktops built into cabinetry. For example, gas cooktops traditionally have at least one gas burner positioned at a cooktop surface for use in heating or cooking an object, such as a cooking utensil and its contents. Control knobs are typically used to adjust the power level of the heating element, e.g., the amount of fuel directed to the burner, and thus the amount of heat delivered by the gas burner.

Normally aspirated gas burners rely on the energy available in the form of pressure from the fuel supplied to the gas burner to entrain air for combustion. Because the nominal pressure in households is relatively low, there is a practical limit to the amount of primary air a normally aspirated gas burner can entrain. Introducing a fan or another forced air supply into a gas burner assembly may improve the mixture of fuel and air for improved operation at higher outputs, with shorter flames and improved stability, and with improved efficiency. Forced air burners often use tall, narrow, and closely spaced burner ports to minimize the burner footprint and flame lengths, thereby improving heat transfer efficiency.

However, commonly used methods of manufacturing burner heads have limited ability to accommodate such high aspect ratio burner ports. For example, when die casting a burner head, the dies used to produce the burner ports would have very thin walls and would lack the strength and wear properties to withstand the stresses of injecting molten metals. Similarly, forging methods would require dies having long, thin projections too fragile to form the high aspect ratio burner ports.

Accordingly, an improved gas burner assembly is desirable. More particularly, a gas burner assembly including an easily manufactured forced air burner having tall, narrow burner ports would be particularly beneficial.

BRIEF DESCRIPTION OF THE INVENTION

The present disclosure relates generally to a gas burner assembly for a cooktop appliance including a lower body and an upper body positioned over the lower body to define a boost burner chamber. A first plurality of projections extends upward from the lower body and a second plurality of projections extends downward from the upper body. The second plurality of projections are interposed between the first plurality of projections to define a plurality of burner ports in fluid communication with the boost burner chamber. In this manner, burner ports are easily manufactured and define a larger height-to-width aspect ratio for improved burner performance. Additional aspects and advantages of the invention will be set forth in part in the following description, or may be apparent from the description, or may be learned through practice of the invention.

In one exemplary embodiment, a gas burner assembly for a cooktop appliance is provided. The gas burner assembly includes a lower body and an upper body positioned over the lower body to define a boost burner chamber. A first plurality of projections is defined by the lower body and extends substantially upward along the axial direction. A second plurality of projections is defined by the upper body and extends substantially downward along the axial direction, the second plurality of projections being interposed between the first plurality of projections to define a plurality of burner ports in fluid communication with the boost burner chamber.

In another exemplary embodiment, a gas burner assembly positioned on a top panel of a cooktop appliance is provided. The gas burner assembly includes a bottom housing defining an axial direction, a radial direction, and a circumferential direction. A center body is positioned concentrically within the bottom housing to define a mixing chamber therebetween, the center body further defining an inner chamber positioned inward of the mixing chamber along the radial direction and a plurality of apertures providing fluid communication between the mixing chamber and the inner chamber. An upper housing is positioned over the center body, the upper housing including a lower body positioned over the center body to define a primary burner chamber and an upper body positioned over the lower body to define a boost burner chamber in fluid communication with the inner chamber of the center body. A first plurality of projections is defined by the lower body and extends substantially upward along the axial direction. A second plurality of projections is defined by the upper body and extends substantially downward along the axial direction, the second plurality of projections being interposed between the first plurality of projections to define a plurality of burner ports in fluid communication with the boost burner chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
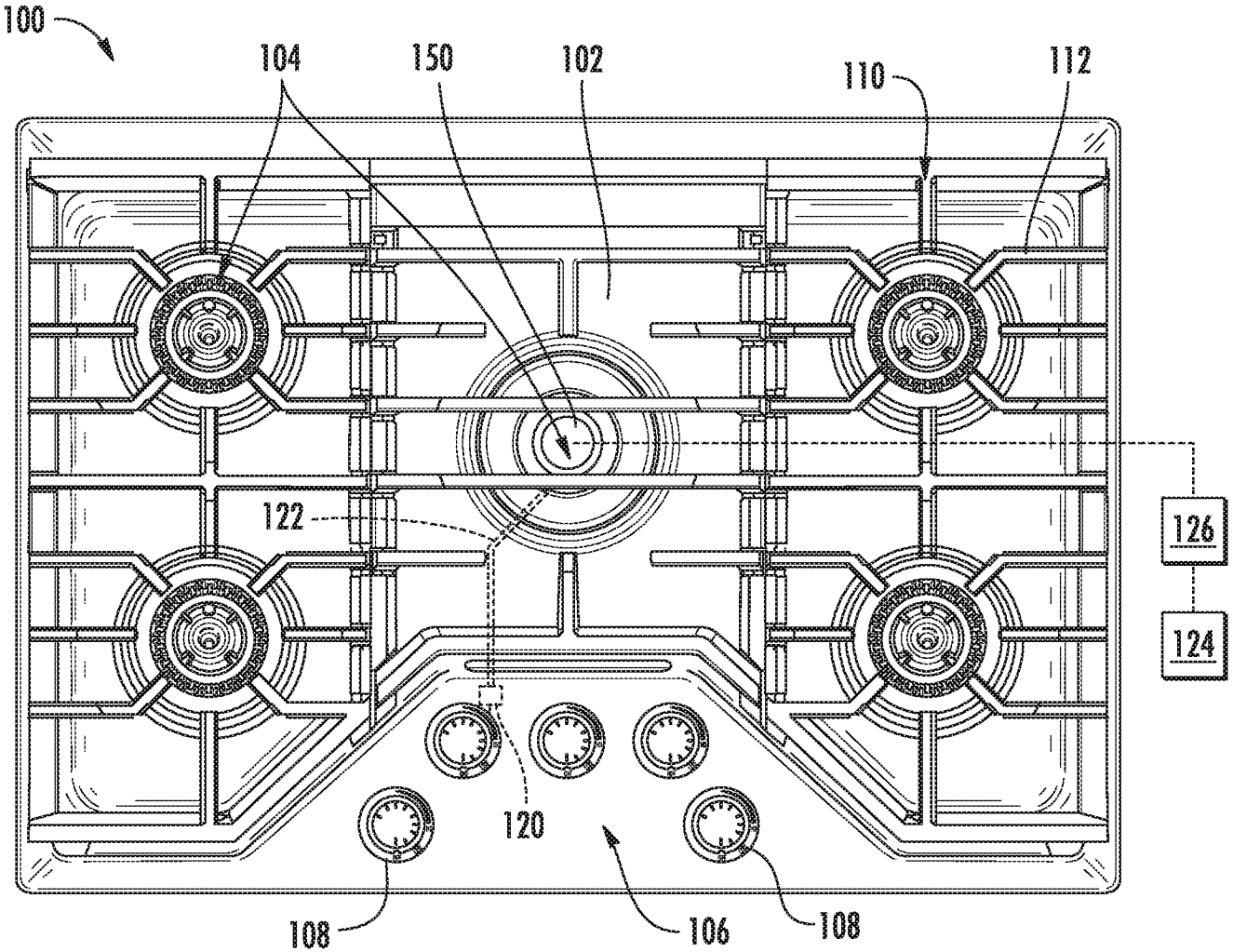
FIG. 1 provides a top view of a cooktop appliance according to an exemplary embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure relates generally to a gas burner assembly for a cooktop appliance 100. Although cooktop appliance 100 is used below for the purpose of explaining the details of the present subject matter, one skilled in the art will appreciate that the present subject matter may apply to any other suitable consumer or commercial appliance. For example, the exemplary gas burner assemblies described below may be used on other types of cooking appliances, such as ranges or oven appliances. Cooktop appliance 100 is used in the discussion below only for the purpose of explanation, and such use is not intended to limit the scope of the present disclosure in any manner.

FIG. 1 illustrates an exemplary embodiment of a cooktop appliance 100 of the present disclosure. Cooktop appliance 100 may be, e.g., fitted integrally with a surface of a kitchen counter, may be configured as a slide-in cooktop unit, or may be a part of a free-standing range cooking appliance. Cooktop appliance 100 includes a top panel 102 that includes one or more heating sources, such as heating elements 104 for use in, e.g., heating or cooking. Top panel 102, as used herein, refers to any upper surface of cooktop appliance 100 on which utensils may be heated and therefore food cooked. In general, top panel 102 may be constructed of any suitably rigid and heat resistant material capable of supporting heating elements 104, cooking utensils, and/or other components of cooktop appliance 100. By way of example, top panel 102 may be constructed of enameled steel, stainless steel, glass, ceramics, and combinations thereof.

According to the illustrated exemplary embodiment, a user interface panel or control panel 106 is located within convenient reach of a user of cooktop appliance 100. For this exemplary embodiment, control panel 106 includes control knobs 108 that are each associated with one of heating elements 104. Control knobs 108 allow the user to activate each heating element 104 and regulate the amount of heat input each heating element 104 provides to a cooking utensil located thereon, as described in more detail below. Although cooktop appliance 100 is illustrated as including control knobs 108 for controlling heating elements 104, it should be understood that control knobs 108 and the configuration of cooktop appliance 100 shown in FIG. 1 is provided by way of example only. More specifically, control panel 106 may include various input components, such as one or more of a variety of touch-type controls, and/or electrical, mechanical or electro-mechanical input devices including rotary dials, push buttons, and touch pads.

According to the illustrated embodiment, control knobs 108 are located within control panel 106 of cooktop appliance 100. However, it should be appreciated that this location is used only for the purpose of explanation, and that other locations and configurations of control panel 106 and control knobs 108 are possible and within the scope of the present subject matter. Indeed, according to alternative embodiments, control knobs 108 may instead be located directly on top panel 102 or elsewhere on cooktop appliance 100, e.g., on a backsplash, front bezel, or any other suitable surface of cooktop appliance 100. Control panel 106 may also be provided with one or more graphical display devices, such as a digital or analog display device designed to provide operational feedback to a user.

According to the illustrated embodiment, cooktop appliance 100 is a gas cooktop and heating elements 104 are gas burners, such as gas burner assembly 150 described below. As illustrated, heating elements 104 are positioned within top panel 102 and have various sizes, as shown in FIG. 1, so as to provide for the receipt of cooking utensils (e.g., pots, pans, etc.) of various sizes and configurations and to provide different heat inputs for such cooking utensils. In addition, cooktop appliance 100 may include one or more grates 110 configured to support a cooking utensil, such as a pot, pan, etc. In general, grates 110 include a plurality of elongated members 112, e.g., formed of cast metal, such as cast iron. The cooking utensil may be placed on the elongated members 112 of each grate 110 such that the cooking utensil rests on an upper surface of elongated members 112 during the cooking process. Heating elements 104 are positioned underneath the various grates 110 such that heating elements 104 provide thermal energy to cooking utensils above top panel 102 by combustion of fuel below the cooking utensils.

Figure 2:
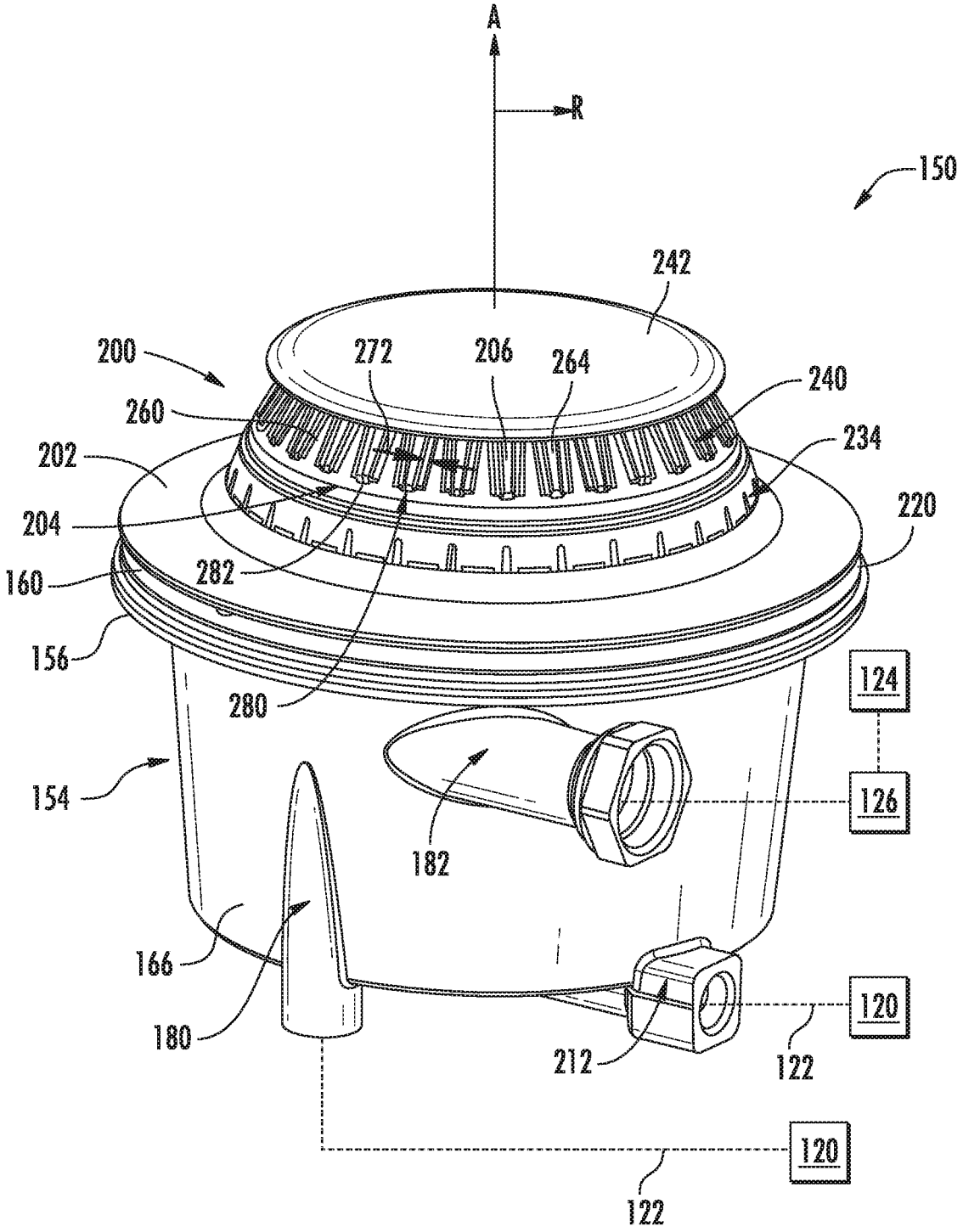
FIG. 2 provides a perspective view of a gas burner assembly of the exemplary cooktop appliance of FIG. 1 according to an exemplary embodiment of the present subject matter.
Figure 3:
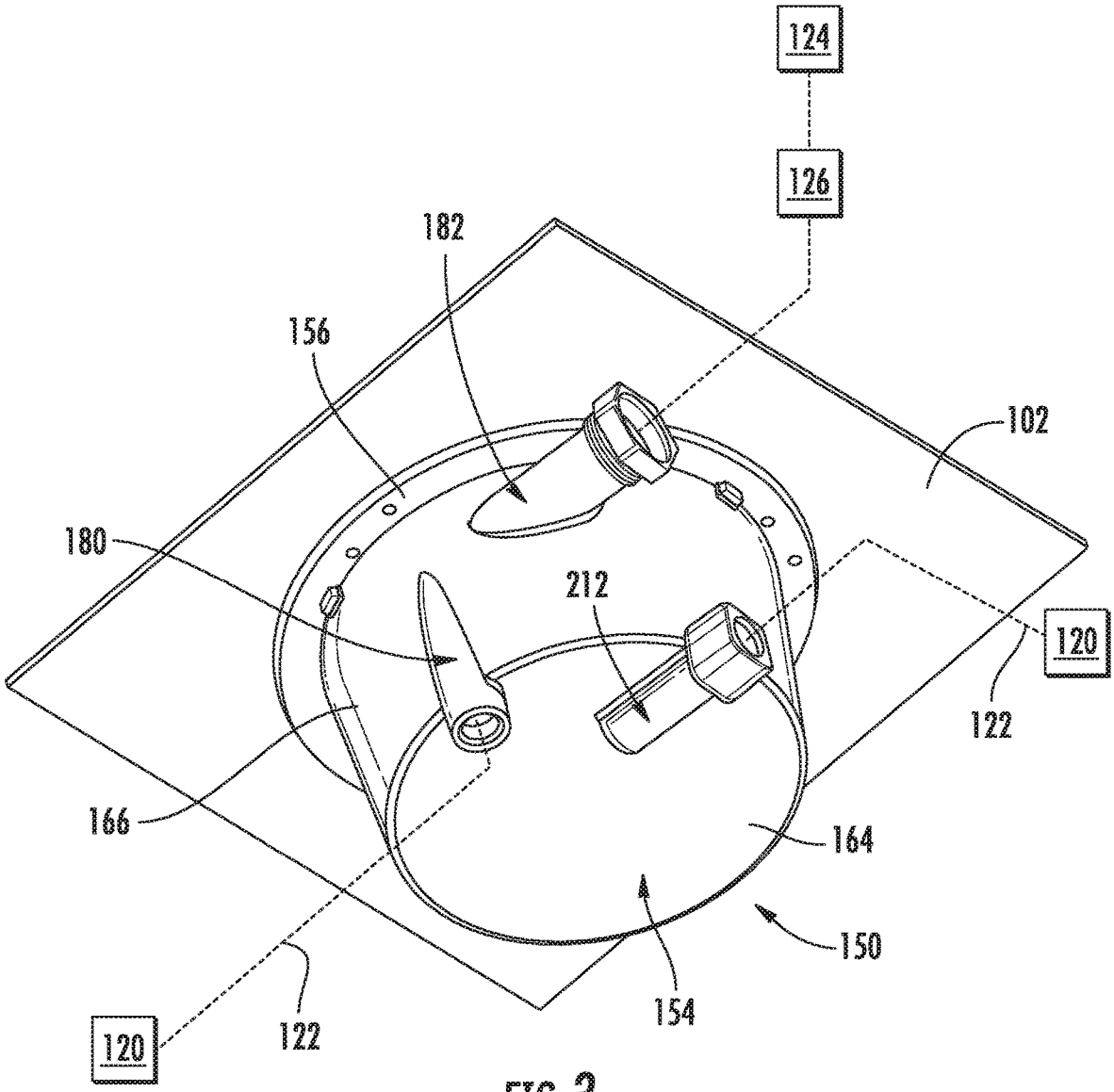
FIG. 3 provides a bottom perspective view of the exemplary gas burner assembly of FIG. 2 positioned within a top panel of the exemplary cooktop appliance of FIG. 1.

As shown schematically in FIGS. 1 through 3, cooktop appliance 100 includes a variety of control elements for regulating the amount of heat generated by heating elements 104. For example, as explained below, heating element 104 is a gas burner assembly 150 that uses one or more flows of fuel and one or more flows of air for combustion. Thus, cooktop appliance 100 includes fuel control valves 120 and fuel lines 122 for supplying a metered amount of fuel to heating element 104. Fuel lines 122 extend between control valves 120 and one or more fuel orifices of heating element 104. Thus, when control valves 120 are open, fuel such as propane or natural gas may flow through fuel lines 122 to the fuel orifices for combustion. Similarly, cooktop appliance 100 includes a forced air supply 124 and an air regulator 126 for controlling the amount of forced air introduced to heating element 104 for combustion. For example, forced air supply 124 may be a fan, an air compressor, or any other suitable source of air.

Cooktop appliance 100 may further include features for assisting mixing of air and fuel as the fuel enters heating element 104, e.g., injectors, Venturi mixers, etc. According to an exemplary embodiment, fuel control valves 120 are each coupled to a respective one of control knobs 108, Thus, a user may adjust fuel control valves 120 with control knobs 108, thereby regulating fuel flow to heating elements 104. Similarly, air regulator 126 may be either directly controlled by control knob 108 or may be controlled based on the amount of fuel supplied to obtain the desired air/fuel ratio for combustion. According to an exemplary embodiment, some or all of these control components may be mounted to panel top 102, e.g., on a bottom surface or underside of top panel 102.

Referring now generally to FIGS. 2 through 10, a gas burner assembly 150 that may be used with cooktop appliance 100 will be described in more detail. Although the discussion below refers to an exemplary gas burner assembly 150, it should be appreciated that the features and configurations described may be used for other heating elements in other cooking appliances or consumer appliances as well. For example, gas burner assembly 150 may be positioned elsewhere within cooktop appliance 100, may have different components or configurations, and use alternative mechanisms for mixing fuel and air for combustion. Other variations and modifications of the exemplary embodiment described below are possible, and such variations are contemplated as within the scope of the present subject matter.

Figure 4:
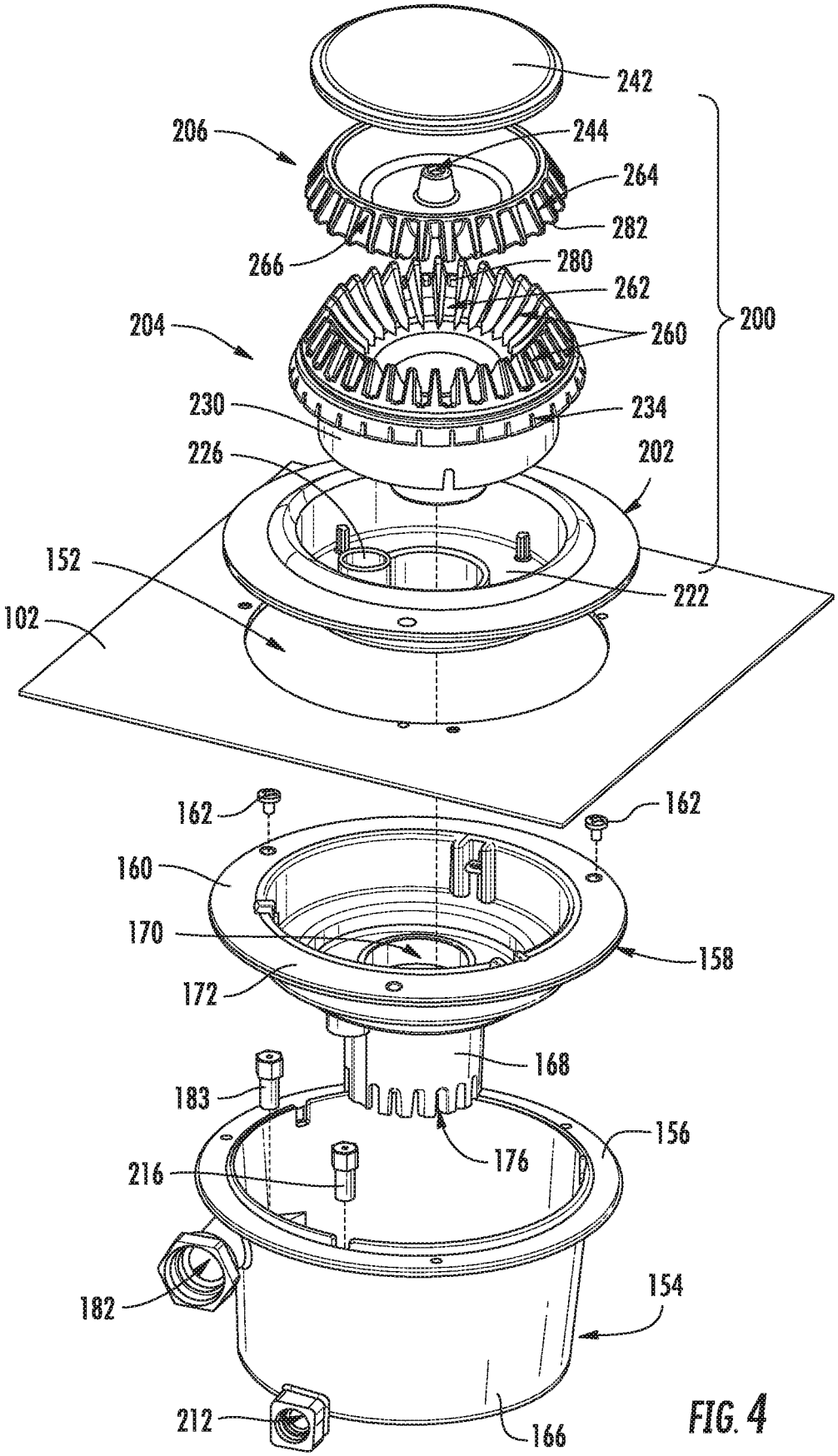
FIG. 4 provides an exploded perspective view of the exemplary gas burner assembly of FIG. 2.

Referring now to FIG. 4, an exploded view of gas burner assembly 150 will be described. As shown, gas burner assembly 150 generally defines an axial direction A, a radial direction R, and a circumferential direction C (see FIG. 5). As illustrated, gas burner assembly 150 is mounted within an aperture 152 defined in top panel 102 of cooktop appliance 100. More specifically, gas burner assembly 150 includes a bottom housing 154 that defines a bottom flange 156 and is generally positioned below top panel 102 and a center body 158 that defines a top flange 160 which is generally positioned above top panel 102. According to the illustrated embodiment, gas burner assembly 150 is installed in aperture 152 by joining bottom housing 154 and center body 158 using any suitable mechanical fastener 162, such as screws, bolts, rivets, etc. Similarly, glue, bonding, snap-fit mechanisms, interference-fit mechanisms, or any suitable combination thereof may be used to join bottom housing 154 and center body 158.

Figure 5:
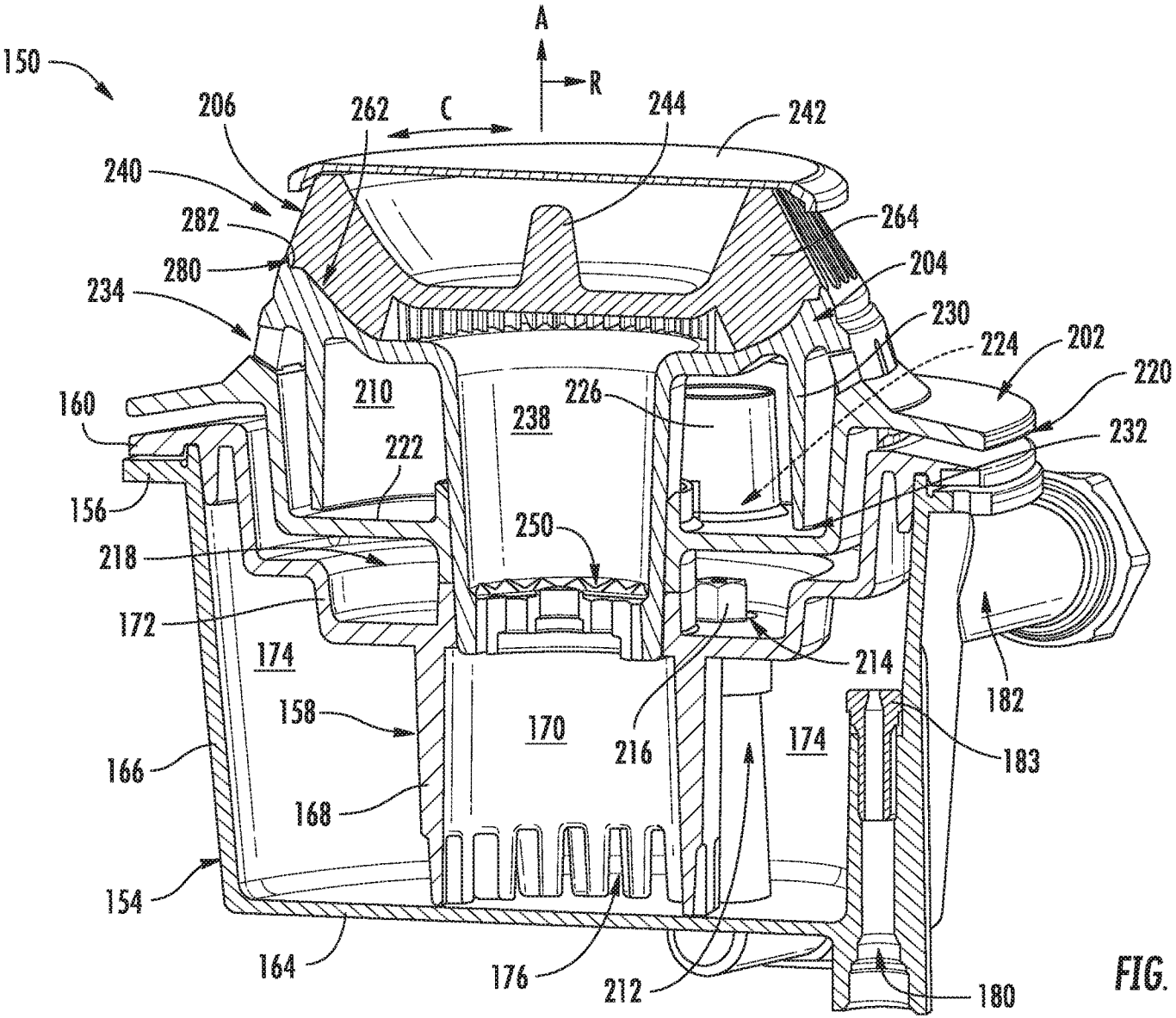
FIG. 5 provides a cross sectional view of the exemplary gas burner assembly of FIG. 2.

Referring now also to FIG. 5, bottom housing 154 includes a bottom wall 164 and a side wall 166 which is generally cylindrically shaped and defines an open top. In addition, center body 158 generally includes a cylindrical lower wall 168 that defines an inner chamber 170 and an upper wall 172 that extends along the radial direction R out to top flange 160. Center body 158 is mounted within bottom housing 154 such that it is positioned concentrically within bottom housing 154 to define an annular mixing chamber 174, e.g., positioned between lower wall 168 and cylindrical wall 166. In this manner, inner chamber 170 is positioned inward of mixing chamber 174 along the radial direction R to define two separate chambers. In addition, according to an exemplary embodiment, lower wall 168 of center body 158 defines a plurality of apertures 176 providing fluid communication between mixing chamber 174 and inner chamber 170.

Mixing chamber 174 and inner chamber 170 are generally configured for receiving a flow of air and a flow of fuel and fully premixing them into a homogenous fuel mixture prior to combustion. In this manner, for example, bottom housing 154 defines a boost fuel inlet 180 and a boost air inlet 182 that are each in fluid communication with mixing chamber 174. Boost fuel inlet 180 and boost air inlet 182 provide a flow of fuel and forced air, respectively, into mixing chamber 174. In order to increase the residence time of the air and fuel to improve mixing, according to the illustrated embodiment, boost fuel inlet 180 and boost air inlet 182 are positioned proximate a top of mixing chamber 174, e.g., adjacent upper wall 172, and the plurality of apertures 176 are defined proximate a bottom of mixing chamber 174, e.g., as slots or openings defined by a distal end of lower wall 168. In this manner, fuel and air injected into mixing chamber 174 travels circumferentially within mixing chamber 174 around lower wall 168 as it migrates towards bottom wall 164 where it enters inner chamber 170 through apertures 176.

Referring now to FIG. 4, an exploded view of gas burner assembly 150 will be described. As shown, gas burner assembly 150 generally defines an axial direction A, a radial direction R, and a circumferential direction C (see FIG. 5). As illustrated, gas burner assembly 150 is mounted within an aperture 152 defined in top panel 102 of cooktop appliance 100. More specifically, gas burner assembly 150 includes a bottom housing 154 that defines a bottom flange 156 and is generally positioned below top panel 102 and a center body 158 that defines a top flange 160 which is generally positioned above top panel 102. According to the illustrated embodiment, gas burner assembly 150 is installed in aperture 152 by joining bottom housing 154 and center body 158 using any suitable mechanical fastener 162, such as screws, bolts, rivets, etc. Similarly, glue, bonding, snap-fit mechanisms, interference-fit mechanisms, or any suitable combination thereof may be used to join bottom housing 154 and center body 158.

Referring now also to FIG. 5, bottom housing 154 includes a bottom wall 164 and a side wall 166 which is generally cylindrically shaped and defines an open top. In addition, center body 158 generally includes a cylindrical lower wall 168 that defines an inner chamber 170 and an upper wall 172 that extends along the radial direction R out to top flange 160. Center body 158 is mounted within bottom housing 154 such that it is positioned concentrically within bottom housing 154 to define an annular mixing chamber 174, e.g., positioned between lower wall 168 and cylindrical wall 166. In this manner, inner chamber 170 is positioned inward of mixing chamber 174 along the radial direction R to define two separate chambers. In addition, according to an exemplary embodiment, lower wall 168 of center body 158 defines a plurality of apertures 176 providing fluid communication between mixing chamber 174 and inner chamber 170.

Mixing chamber 174 and inner chamber 170 are generally configured for receiving a flow of air and a flow of fuel and fully premixing them into a homogenous fuel mixture prior to combustion. In this manner, for example, bottom housing 154 defines a boost fuel inlet 180 and a boost air inlet 182 that are each in fluid communication with mixing chamber 174. Boost fuel inlet 180 and boost air inlet 182 provide a flow of fuel and forced air, respectively, into mixing chamber 174. In order to increase the residence time of the air and fuel to improve mixing, according to the illustrated embodiment, boost fuel inlet 180 and boost air inlet 182 are positioned proximate a top of mixing chamber 174, e.g., adjacent upper wall 172, and the plurality of apertures 176 are defined proximate a bottom of mixing chamber 174, e.g., as slots or openings defined by a distal end of lower wall 168. In this manner, fuel and air injected into mixing chamber 174 travels circumferentially within mixing chamber 174 around lower wall 168 as it migrates towards bottom wall 164 where it enters inner chamber 170 through apertures 176.

Figure 6:
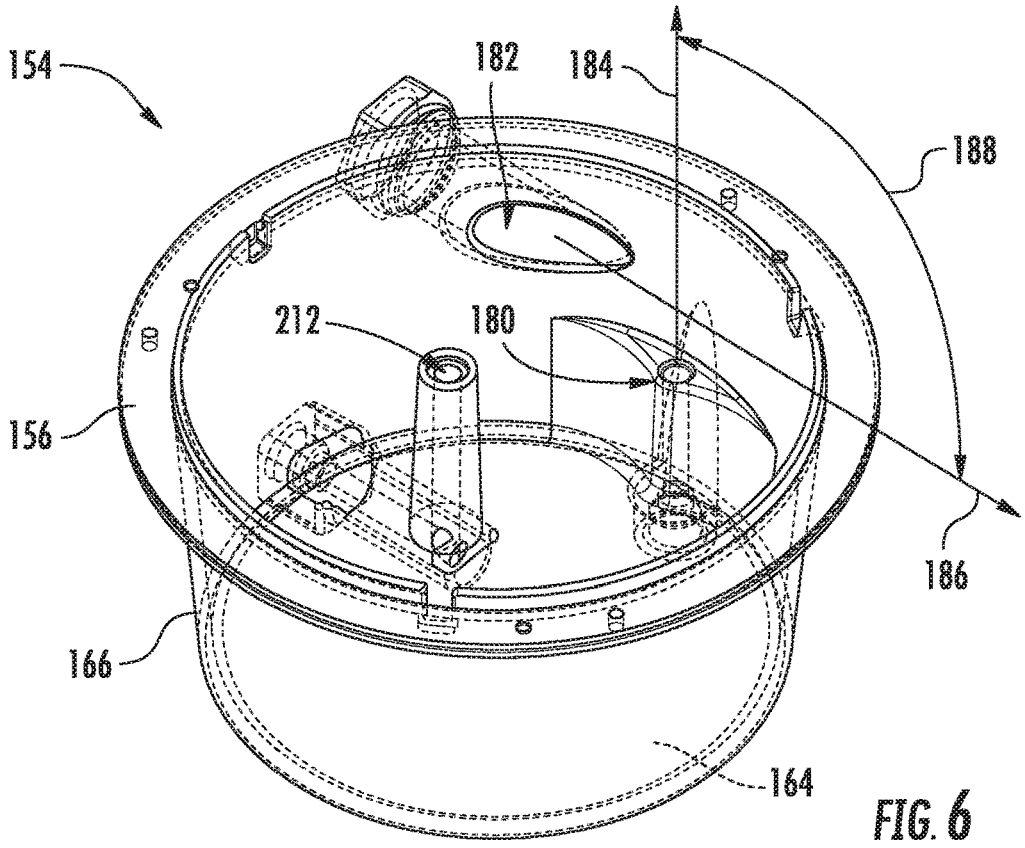
FIG. 6 provides a top perspective view of a bottom housing of the exemplary gas burner assembly of FIG. 2 with fuel and air inlets illustrated in phantom.

As best illustrated in FIG. 6, bottom housing 154 includes a variety of features to facilitate proper mixing of fuel and air for combustion. For example, boost fuel inlet 180 may terminate in a spray nozzle 183 (see FIGS. 4 and 5) for directing the flow of fuel as desired. In addition, as illustrated, boost fuel inlet 180 injects a flow of fuel along a first direction 184 and boost air inlet 182 injects a flow of air along a second direction 186. In order to generate turbulence between the two flows, second direction 186 is substantially perpendicular to first direction 184. More specifically, first direction 184 and second direction 186 define an intersection angle 188 of approximately 90 degrees. It should be appreciated that intersection angle 188 may vary according to alternative embodiments.

In addition, first direction 184 is substantially parallel to the axial direction A such that fuel is injected upward and second direction 186 extends tangentially from cylindrical wall 166 such that boost air inlet 182 discharges air tangentially. Moreover, boost fuel inlet 180 and boost air inlet 182 are illustrated as being positioned proximate to each other on bottom housing 154 such that the flow of air and fuel have high velocity when they begin mixing. The interaction between the two flows results in a desirable swirling motion within mixing chamber 174 and results in high turbulence and extended residence time.

Figure 7:
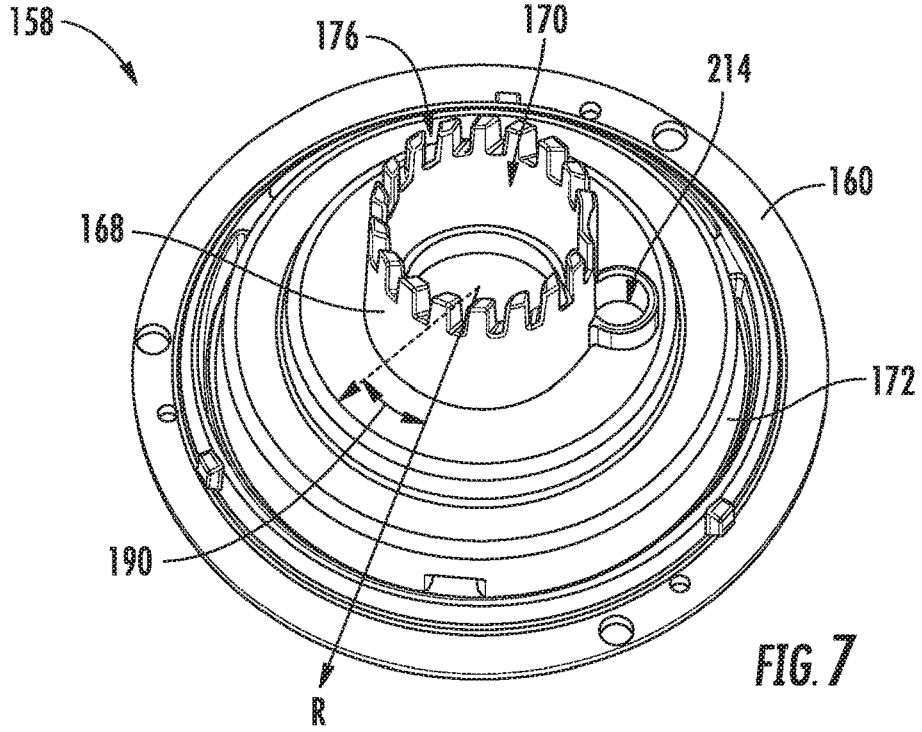
FIG. 7 provides a bottom perspective view of a center body of the exemplary gas burner assembly of FIG. 2.

As best illustrated in FIG. 7, center body 158 also includes features to facilitate proper mixing of fuel and air for combustion. For example, as illustrated, apertures 176 extend through center body 158 at an angle 190 relative to the radial direction R. Angle 190 may be selected to reduce drag on the flow of fuel and air and/or to continue swirling the flows for improved mixing.

Referring again to FIGS. 4 and 5, cooktop appliance 100 further includes an upper housing assembly or upper housing 200 positioned over center body 158 along the axial direction A. Upper housing 200 may include one or more components for receiving and conditioning one or more flows of fuel and air and passing it to various flame ports defined by upper housing 200. As shown in the figures, upper housing 200 includes a burner seat 202, a lower body 204, and an upper body 206 that are generally stacked along the axial direction A. When assembled, upper housing 200 defines both a primary burner and a boost burner, which will be described in more detail below.

Referring specifically to FIGS. 4 and 5, upper housing 200 defines a primary burner chamber 210, or more specifically, lower body 204 is positioned over burner seat 202 to define a primary burner chamber 210 therebetween. A primary fuel inlet 212 is in fluid communication with primary burner chamber 210 for providing a flow of fuel into primary burner chamber 210. More specifically, as illustrated in FIGS. 4 through 7, primary fuel inlet 212 passes from bottom wall 164 of bottom housing 154 along the axial direction A through mixing chamber 174. Primary fuel inlet 212 then passes through an aperture 214 (FIG. 7) defined in upper wall 172 of center body 158 and terminates in a spray nozzle 216 within an air entrainment chamber 218 defined between upper wall 172 and burner seat 202 of upper housing 200.

Air entrainment chamber 218 is in fluid communication with a primary air inlet 220 that extends about the circumferential direction C above top panel 102 of cooktop appliance 100. More specifically, primary air inlet 220 is defined between upper wall 172 of center body 158 and burner seat 202 of upper housing 200. In this manner, fresh primary supply air may be drawn from ambient air through primary air inlet 220 into air entrainment chamber 218, in addition, as best shown in FIG. 5, air entrainment chamber 218 is separated from primary burner chamber 210 by a divider wall 222 that extends along the radial direction R and is part of burner seat 202. Divider wall 222 defines an aperture 224 (see FIG. 5) through which fuel discharged from spray nozzle 216 passes through air entrainment chamber 218 and into primary burner chamber 210. In this manner, ambient air from within air entrainment chamber 218 is entrained and mixed with the supply of fuel from primary fuel inlet 212 as it is injected into primary burner chamber 210.

In addition, a cylindrical channel 226 extends around aperture 224 and toward lower body 204 of upper housing 200. Notably, cylindrical channel 226 terminates proximate a top of primary burner chamber 210, i.e., adjacent lower body 204 of upper housing 200. In this manner, cylindrical channel 226 discharges a mixture of fuel and air proximate a top of primary burner chamber 210. In addition, lower body 204 of upper housing 200 defines a circumferential baffle 230 that is positioned within primary burner chamber 210 and extends down along the axial direction A toward burner seat 202 to define an annular opening 232 proximate a bottom of primary burner chamber 210. In this manner, the fuel and air mixture that is ejected into primary burner chamber 210 migrates from a top of primary burner chamber 210 downward along the axial direction A toward annular opening 232, thereby increasing residence time and ensuring the mixture is more evenly dispersed throughout primary burner chamber 210 for improved combustion.

Upper housing 200 also defines a plurality of primary flame ports 234 spaced about the circumferential direction C and in fluid communication with primary burner chamber 210 via annular opening 232. More specifically, primary flame ports 234 are defined between lower body 204 and burner seat 202 of upper housing 200. In this manner, primary flame ports 234 are positioned below a plurality of boost burner ports 240 along the axial direction A, as will be described in detail below.

In addition to including a primary burner as described above, gas burner assembly 150 further includes a boost burner. According to an exemplary embodiment, the primary burner is a normally aspirated burner that may be regulated for normal operation while the boost burner is a discretely operating (i.e., on or off) auxiliary forced air burner intended for performing high heat operations such as boiling a large pot of water. However, it should be appreciated that the primary burner and boost burner may both be incrementally regulated simultaneously or independently of each other according to alternative embodiments.

Referring now to NG. 5, upper housing 200 generally defines a boost burner chamber 238 (FIG. 5) that extends along the axial direction A and is in fluid communication with inner chamber 170 of center body 158. More specifically, upper body 206 is positioned over lower body 204 along the axial direction A to define boost burner chamber 238. In this manner, boost burner chamber 238 receives a flow of boost fuel from boost fuel inlet 180 and of boost air from boost air inlet 182.

Figure 8:
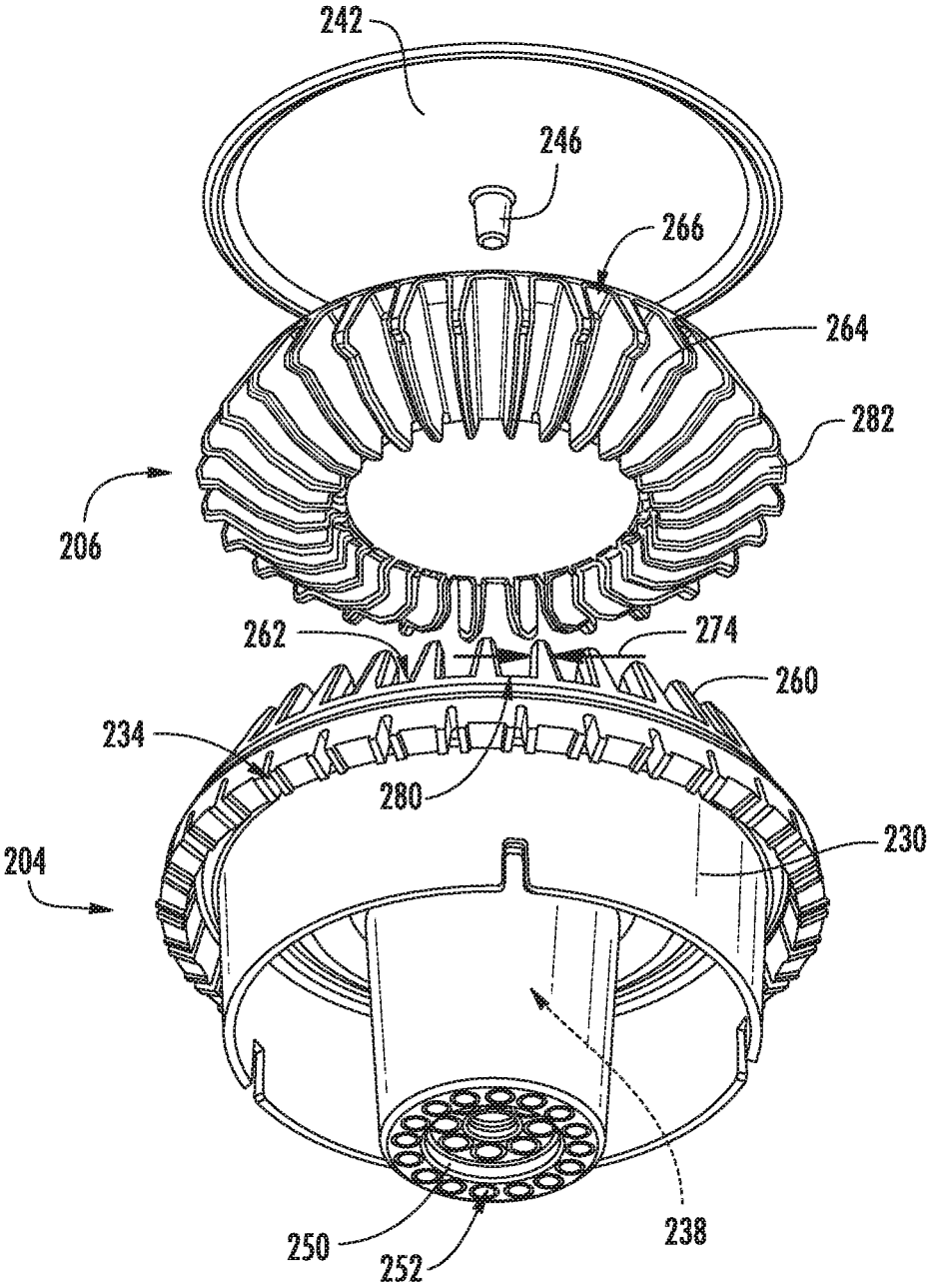
FIG. 8 provides an exploded, bottom perspective view of an upper housing of the exemplary gas burner assembly of FIG. 2.
Figure 9:
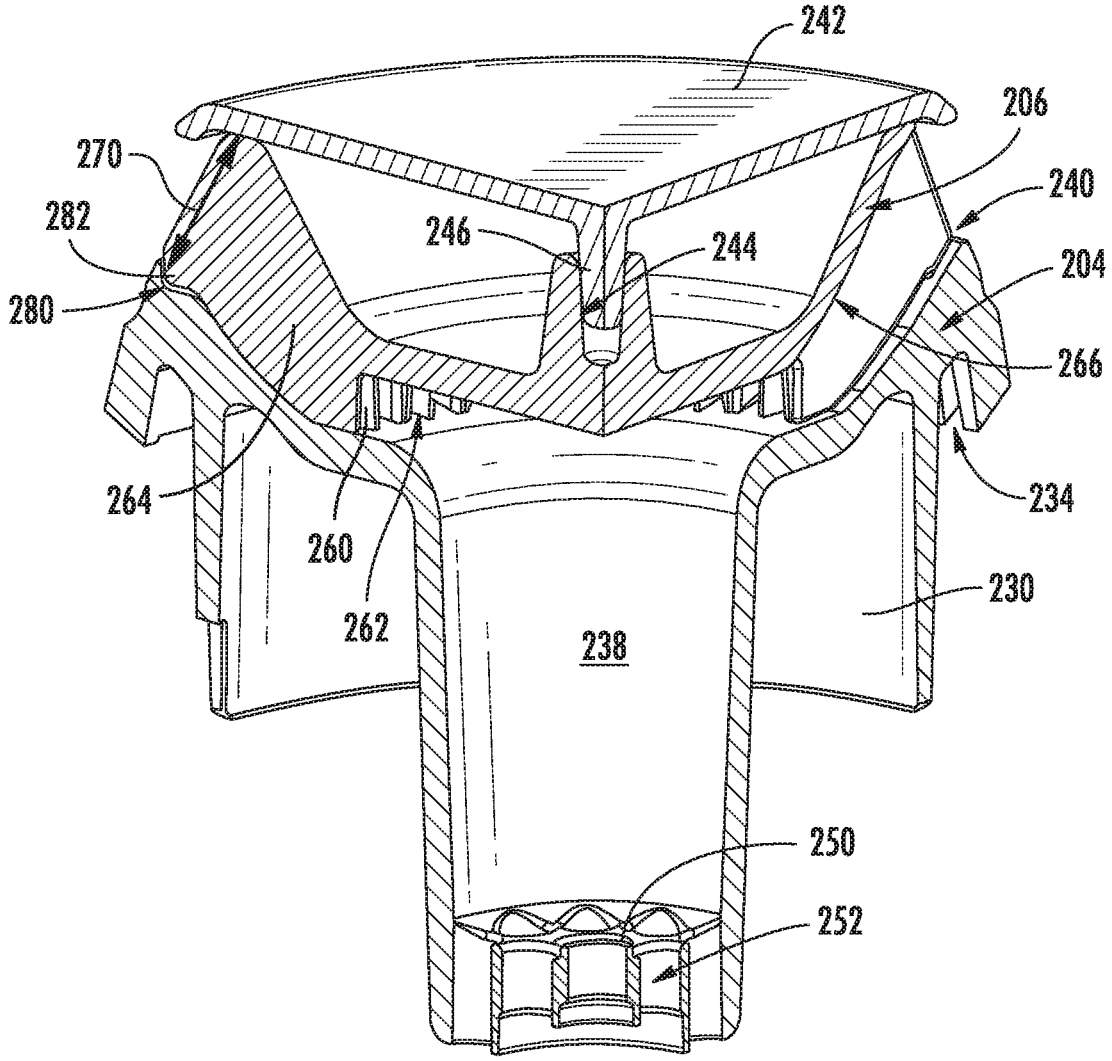
FIG. 9 provides a cross sectional view of the exemplary upper housing of FIG. 8, cut along two planes.

As shown also in FIGS. 8 and 9 and mentioned above, lower body 204 and upper body 206 are joined to define a plurality of boost burner ports, referred to herein as boost burner ports 240 spaced about the circumferential direction C and in fluid communication with boost burner chamber 238. Boost burner ports 240 will be described in more detail below. In addition, a top cap 242 is positioned on top of upper body 206 to provide a clean appearance to gas burner assembly 150 and to help disperse the fuel mixture around boost burner ports 240. In order to center top cap 242 on upper body 206, upper body 206 defines a center boss 244 configured for receiving a spindle 246 extending from top cap 242.

Gas burner assembly 150 further includes a flow developer 250 for straightening the flow of fuel mixture prior to passing through boost burner ports 240. For example, as illustrated, lower body 204 defines flow developer 250 which is positioned between inner chamber 170 and boost burner chamber 238 for straightening or conditioning a flow of mixed fuel and air. It should be appreciated that although flow developer 250 is illustrated as being positioned at a bottom of upper housing 200, flow developer 250 could be defined by center body 158 or could be a separate component according to alternative embodiments. In general, flow developer 250 includes a plurality of conduits or passageways 252 that extend generally along the axial direction A between inner chamber 170 and boost burner chamber 238. According to alternative embodiments, flow developer 250 may include a plurality of fins extending along the axial direction A or any other flow straightening structure.

Figure 10:
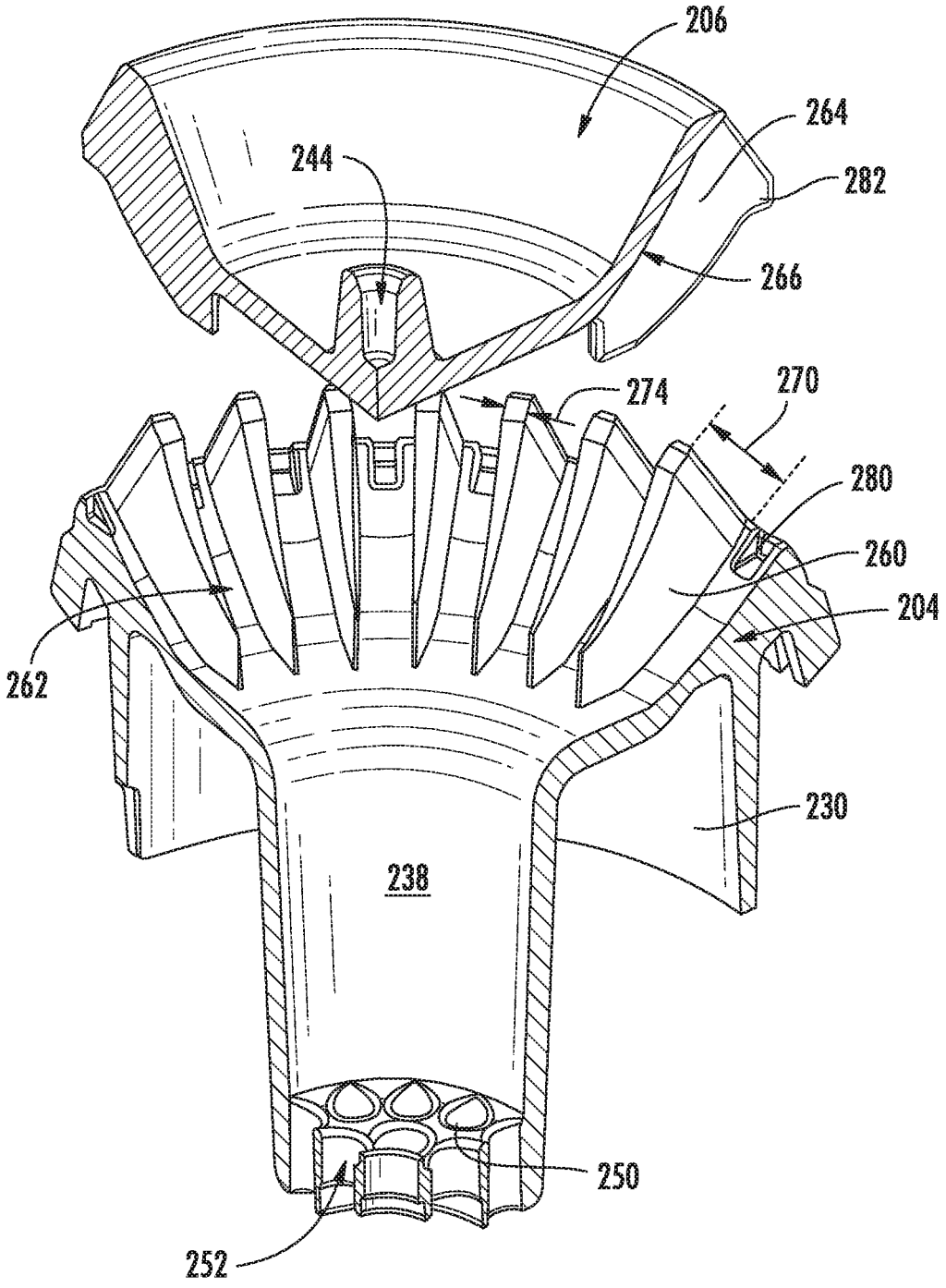
FIG. 10 provides an exploded, cross sectional view of the exemplary upper housing of FIG. 8, cut along two planes.

Referring now specifically to FIGS. 8 through 10, lower body 204 further defines a first plurality of projections, referred to herein as first projections 260. First projections 260 extend substantially upward along the axial direction A, i.e., toward upper body 206. More specifically, for example, first projections 260 extend from a top surface 262 of lower body 204. Similarly, a second plurality of projections, referred to herein as second projections 264, are defined by upper body 206 and extend substantially downward along the axial direction A, e.g., toward lower body 204. More specifically, for example, second projections 264 extend from a bottom surface 266 of upper body 206. It should be appreciated that as used herein, terms of approximation, such as "approximately," "substantially," or "about," refer to being within a ten percent margin of error.

Notably, second projections 264 are interposed between first projections 260 to define boost flame ports or boost burner ports 240 which are in fluid communication with boost burner chamber 238. In this regard, for example, projections 260, 264 alternate between each other around the circumferential direction C. In addition, first projections 260 may extend proximate to, or be in contact with, upper body 206. Similarly, second projections 264 may extend proximate to, or be in contact with, lower body 204. In this manner, each of the plurality of boost burner ports 240 are defined at least in part by top surface 262, one of first projections 260, bottom surface 266, and one of second projections 264.

Referring still to FIGS. 8 through 10, each of the plurality of boost burner ports 240 define a port height 270 that is measured along the axial direction A between top surface 262 of lower body 204 and bottom surface 266 of upper body 206. In addition, each of the plurality, of boost burner ports 240 define a port width 272 (see FIG. 2) that is measured along the circumferential direction C between adjacent projections 260, 264 which define that boost burner port 240. More specifically, port width 272 may be measured as a maximum width of each boost burner port 240. By contrast, according to alternative embodiments, port width 272 may instead refer to an average width, a minimum width, a width at a specific axial location of boost burner port 240, etc. As explained above, it is desirable to have tall, narrow flame ports for forced air burners. Thus, according to an exemplary embodiment of the present subject matter, one or more of boost burner ports 240 define an aspect ratio, which is equivalent to the port height 270 over the port width 272, which is greater than two to one. According to still other embodiments, the aspect ratio is greater than six to one or greater than ten to one.

For example, according to one embodiment, the port width 272 of at least one of the plurality of boost burner ports 240 is approximately two millimeters and the port height 270 is approximately ten millimeters or more. Alternatively, the port width 272 may be less than two millimeters. Notably, the ability to easily manufacture upper housing 200 such that boost burner ports 240 are so narrow is achieved by manufacturing lower body 204 and upper body 206 separately and then joining them together with interwoven projections 260, 264 to define the boost burner ports 240.

In addition, one or more of first projections 260 and second projections 264 may define a projection width 274 measured along the circumferential direction C. More specifically, projection width 274 may be measured as a maximum width of each projection 260, 264. By contrast, according to alternative embodiments, projection width 274 may instead refer to an average width, a minimum width, a width at a specific axial location of projections 260, 264, etc. According to an exemplary embodiment of the present subject matter, the projection width 274 may be less than 1.5 times the port width 272 of at least one of the plurality of boost burner ports 240. In this regard, continuing the example from above, if the port width 272 is two millimeters, the projection width 274 may be 3 millimeters or less according to an exemplary embodiment.

According to an exemplary embodiment of the present subject matter, lower body 204 and upper body 206 may include various features for ensuring that second projections 264 are properly positioned or interwoven with first projections 260. In this regard, for example, lower body 204 defines one or more alignment features and upper body 206 defines one or more complementary features configured for engaging the alignment features to properly position upper body 206 over lower body 204. More specifically, referring still to FIGS. 8 through 10, the alignment features include an indentation 280 defined by lower body 204 between two of first projections 260 and the complementary features include a protrusion 282 extending from one or more of second projections 264. Protrusion 282 is configured for receipt within indentation 280 to center each of second projections 264 between two adjacent first projections 260. Although lower body 204 is illustrated as defining indentations 280 between each of first projections 260 and upper body 206 is illustrated as defining protrusions 282 on each of the second plurality of projections 264, it should be appreciated that any suitable number, size, or position of alignment or indexing features may be used according to alternative embodiments.

Lower body 204 and upper body 206 may define any suitable number and size of projections 260, 264 to achieve the desired size and shape of boost burner ports 240. For example, according to one embodiment, first projections 260 and second projections 264 may each include greater than twenty projections. According to the illustrated embodiment, first projections 260 and second projections 264 may each include greater than about thirty projections. Notably, lower body 204, upper body 206, and their defined projections 260, 264 may be formed using any suitable process. For example, according to an exemplary embodiment, at least one of lower body 204 and upper body 206 are formed by a die casting process, a forging process, or any other suitable manufacturing method.

One skilled in the art will appreciate that in addition to the configurations of gas burner assembly 150 described herein, alternative configurations of gas burner assembly 150 are possible and within the scope of the present subject matter. For example, the size, positioning, and configuration of bottom housing 154, center body 158, and upper housing 200 may vary, the various fuel and air mixing chambers may be positioned differently, and other mixing features or configurations may be used. It should be appreciated that still other configurations are possible and within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims

What is claimed is:

1. A gas burner assembly for a cooktop appliance, the gas burner assembly comprising:

a lower body;

an upper body positioned over the lower body to define a boost burner chamber;

a first plurality of projections defined by the lower body and extending substantially upward along an axial direction, a distal end of each of the first plurality of projections being seated against the upper body; and a second plurality of projections defined by the upper body and extending substantially downward along the axial direction, a distal end of each of the second plurality of projections having a horizontal surface seated in direct contact against the lower body and being interposed between the first plurality of projections to define a plurality of burner ports in fluid communication with the boost burner chamber.

2. The gas burner assembly of claim 1, wherein each of the plurality of burner ports has an aspect ratio defined as a height of the burner port over a maximum port width of the burner port, the aspect ratio being greater than six to one.

3. The gas burner assembly of claim 1, wherein each of the plurality of burner ports defines a maximum port width measured between one of the first plurality of projections and one of the second plurality of projections, the maximum port width of at least one of the plurality of burner ports being between 0.1 millimeters and two millimeters.

4. The gas burner assembly of claim 1, wherein each of the plurality of burner ports defines a maximum port width of the burner port and each of the first plurality of projections defines a maximum projection width, the maximum projection width of at least one of the first plurality of projections between 0.1 times and 1.5 times the maximum port width of at least one of the plurality of burner ports.

5. The gas burner assembly of claim 1, wherein the lower body defines one or more alignment features and the upper body defines one or more complementary features configured for engaging the alignment features to properly position the upper body over the lower body.

6. The gas burner assembly of claim 5, wherein the alignment features comprise an indentation defined by the lower body between two of the first plurality of projections, and the complementary features comprise a protrusion extending from one of the second plurality of projections, the protrusion being configured for receipt within the indentation.

7. The gas burner assembly of claim 1, wherein the first plurality of projections and the second plurality of projections each comprise greater than twenty projections.

8. The gas burner assembly of claim 1, wherein at least one of the lower body and the upper body are formed by a die casting process.

9. The gas burner assembly of claim 1, wherein at least one of the lower body and the upper body are formed by a forging process.

10. The gas burner assembly of claim 1, the gas burner assembly further comprising:

a bottom housing defining an axial direction, a radial direction, and a circumferential direction;

a center body positioned concentrically within the bottom housing to define a mixing chamber therebetween, the center body further defining an inner chamber positioned inward of the mixing chamber along the radial direction and a plurality of apertures providing fluid communication between the mixing chamber and the inner chamber;

an upper housing including the lower body and the upper body, the upper housing being positioned over the center body to define a primary burner chamber and such that the boost burner chamber is in fluid communication with the inner chamber of the center body;

a primary fuel inlet in fluid communication with the primary burner chamber; and a boost fuel inlet and a boost air inlet in fluid communication with the mixing chamber.

11. The gas burner assembly of claim 10, further comprising:

a forced air supply source fluidly coupled to the boost air inlet, wherein the boost air inlet is defined by the bottom housing.

12. The gas burner assembly of claim 10, wherein the plurality of burner ports are boost flame ports and the upper housing defines:

a plurality of primary flame ports spaced about the circumferential direction and in fluid communication with the primary burner chamber, the plurality of primary flame ports being positioned below the boost flame ports along the axial direction.

13. The gas burner assembly of claim 10, wherein the upper housing defines a flow developer positioned between the inner chamber and the boost burner chamber for straightening or conditioning a flow of mixed fuel and air.

14. A gas burner assembly positioned on a top panel of a cooktop appliance, the gas burner assembly comprising:

a bottom housing defining an axial direction, a radial direction, and a circumferential direction;

a center body positioned concentrically within the bottom housing to define a mixing chamber therebetween, the center body further defining an inner chamber positioned inward of the mixing chamber along the radial direction and a plurality of apertures providing fluid communication between the mixing chamber and the inner chamber;

an upper housing positioned over the center body, the upper housing comprising:

a lower body positioned over the center body to define a primary burner chamber;

an upper body positioned over the lower body to define a boost burner chamber in fluid communication with the inner chamber of the center body;

a first plurality of projections defined by the lower body and extending substantially upward along the axial direction, a distal end of each of the first plurality of projections being seated against the upper body; and a second plurality of projections defined by the upper body and extending substantially downward along the axial direction, a distal end of each of the second plurality of projections having a horizontal surface seated in direct contact against the lower body and being interposed between the first plurality of projections to define a plurality of burner ports in fluid communication with the boost burner chamber.

15. The gas burner assembly of claim 14, wherein each of the plurality of burner ports has an aspect ratio defined as a height of the burner port over a maximum port width of the burner port, the aspect ratio being greater than six to one.

16. The gas burner assembly of claim 14, wherein each of the plurality of burner ports defines a maximum port width measured between one of the first plurality of projections and one of the second plurality of projections, the maximum port width of at least one of the plurality of burner ports being between 0.1 millimeters and two millimeters.

17. The gas burner assembly of claim 14, wherein each of the plurality of burner ports defines a maximum port width of the burner port and each of the first plurality of projections defines a maximum projection width, the maximum projection width of at least one of the first plurality of projections between 0.1 times and 1.5 times the maximum port width of at least one of the plurality of burner ports.

18. The gas burner assembly of claim 14, wherein the lower body defines one or more alignment features and the upper body defines one or more complementary features configured for engaging the alignment features to properly position the upper body over the lower body.

19. The gas burner assembly of claim 18, wherein the alignment features comprise an indentation defined by the lower body between two of the first plurality of projections, and the complementary features comprise a protrusion extending from one of the second plurality of projections, the protrusion being configured for receipt within the indentation.

20. The gas burner assembly of claim 14, wherein at least one of the lower body and the upper body are formed by either a die casting process or a forging process.

* * * * *